US006056542A

United States Patent [19]

Lannes et al.

[11] Patent Number: 6,056,542

[45] Date of Patent: May 2, 2000

[54] BURNER FOR REDUCING NITROGEN OXIDES AND CARBON MONOXIDE

[75] Inventors: Eric M. Lannes, Kentwood; Timothy D. Scott, Battle Creek, both of Mich.

[73] Assignee: Bradford White Corporation, Ambler, Pa.

[21] Appl. No.: 09/366,129

[22] Filed: Aug. 2, 1999

Related U.S. Application Data

[63] Continuation-in-part of application No. 09/027,034, Feb. 20, 1998, Pat. No. 5,954,492.

[51] Int. Cl.[7] ..... F23D 14/62; F23C 5/08; B05B 1/24; F22B 5/00

[52] U.S. Cl. ..... 431/354; 431/177; 431/171; 126/39 R; 126/39 E; 126/39 K; 126/361; 239/128; 122/14

[58] Field of Search ..... 431/8, 9, 347, 431/354, 349, 350, 264, 266, 177, 171; 126/39 R, 39 A, 39 B, 39 C, 39 D, 39 E, 39 F, 39 G, 39 H, 39 I, 39 J, 39 K, 39 L, 39 M, 361, 344, 390, 391, 392; 122/14, 17; 239/128, 132.3

[56] References Cited

U.S. PATENT DOCUMENTS

| | | | |
|---|---|---|---|
| 2,220,247 | 11/1940 | Kochendorfer et al. | 431/349 |
| 2,409,421 | 10/1946 | Dufault | 431/350 |
| 3,615,249 | 10/1971 | Martois | 422/183 |
| 3,632,287 | 1/1972 | Reed et al. | 431/350 |
| 3,817,689 | 6/1974 | Capy | 431/349 |
| 4,165,963 | 8/1979 | Nozaki | 431/354 |
| 4,284,402 | 8/1981 | Sheets et al. | 431/9 |
| 4,525,141 | 6/1985 | DeWerth et al. | 431/347 |
| 4,569,328 | 2/1986 | Shukla et al. | 126/39 J |

OTHER PUBLICATIONS

Zawada, W.S. et al., "Minimizing Emissions of Nitrogen Oxides from Domestic Water Heaters", American Gas Association Laboratories Report No. ES66052D,Southern California Gas Company, Mar., 1973.

Raghavan, J. et al., "Survey of Emissions–Reduction Technology Applicable to Gas–Fired Apprliances", Gas Research Institute, Chicago, IL, Aug., 1994.

Murphy, Michael J. et al., "Burner Technology Bulletin: Control of $No_x$ Emissions From Residential Gas Appliances", Gas Research Institute, Chicago, IL, Apr. 1985.

Creamer, K.S. et al., "Primary Aeration as a $No_x$ Control Strategy", Gas Research Institute, Chicago, IL, Apr., 1995.

Weber, E.J., "Principles of Secondary Aeration of Atmospheric Gas Burners", American Gas Association Laboratories, Cleveland, OH and Los Angeles, CA., Nov., 1960.

*Primary Examiner*—Ira S. Lazarus
*Assistant Examiner*—David Lee
*Attorney, Agent, or Firm*—Robert A. Koons, Jr.; James W. Bolcsak; Pepper Hamilton LLP

[57] ABSTRACT

A burner is disclosed, comprising: a burner body and a burner lid coupled to the burner body so as to form a plurality of gas ports in a substantially circular and substantially planar arrangement, said gas ports being interposed between the burner body and the burner lid and adapted to have a corresponding array of flames extending from the gas ports during combustion of a fuel gas. The burner also comprises an air shield member co-formed to and extending radially from the burner body or the burner lid; and a plurality of flame partitions, each flame partition being co-formed to the air shield member and extending radially from the air shield member along an axis, the flame partitions being spaced around the air shield member so that each flame partition is in substantial radial alignment with at least one gas port, each flame partition comprising a first tab and a second tab, the first tab and the second tab being connected along the axis and extending radially from the axis such that the first and second tabs are substantially perpendicular, wherein at least one of the tabs extends in a direction that would intersect a plane formed by the substantially planar arrangement of gas ports.

(List continued on next page.)

34 Claims, 10 Drawing Sheets

U.S. PATENT DOCUMENTS

| | | | |
|---|---|---|---|
| 4,616,994 | 10/1986 | Tomlinson | 431/347 |
| 4,629,415 | 12/1986 | DeWerth et al. | 431/347 |
| 4,652,236 | 3/1987 | Viessmann | 431/350 |
| 4,904,179 | 2/1990 | Drago et al. | 431/347 |
| 5,002,038 | 3/1991 | Riehl | 126/39 R |
| 5,040,970 | 8/1991 | Riehl | 431/264 |
| 5,112,218 | 5/1992 | Sigler | 431/354 |
| 5,133,334 | 7/1992 | Riehl | 126/39 R |
| 5,215,457 | 6/1993 | Sebastiani | 431/7 |
| 5,266,026 | 11/1993 | Riehl | 126/39 E |
| 5,328,357 | 7/1994 | Riehl | 126/39 E |
| 5,335,646 | 8/1994 | Katchka | 126/350 R |
| 5,405,263 | 4/1995 | Gerdes et al. | 126/39 E |
| 5,427,525 | 6/1995 | Shukla et al. | 431/350 |
| 5,511,516 | 4/1996 | Moore, Jr. et al. | 126/391 |
| 5,620,317 | 4/1997 | Sigler | 126/30 M |
| 5,658,139 | 8/1997 | Flanagan et al. | 431/7 |
| 5,826,569 | 10/1998 | Voorhis | 126/361 |
| 5,879,154 | 3/1999 | Suchovsky | 431/326 |
| 5,954,492 | 9/1999 | Lannes et al. | 431/177 |

BURNER FOR REDUCING NITROGEN OXIDES AND CARBON MONOXIDE

This application is a continuation-in-part of Ser. No. 09/027,034, filed Feb. 20, 1998, now U.S. Pat. No. 5,954, 492.

BACKGROUND OF THE INVENTION

1. Field of the Invention

The present invention relates to an atmospheric burner. More particularly, the invention relates to an atmospheric burner for use in gas-fueled appliances which reduces emissions of NO, $NO_2$ and carbon monoxide.

2. Description of the Related Art

Atmospheric burners are commonly used in appliances which use a gas as a fuel. Gaseous hydrocarbons such as methane (natural gas) or propane (bottled gas) may be used as a fuel in such appliances. Common appliances of these types include water heaters, furnaces, boilers, space heaters, ranges and clothes dryers.

When fuels such as hydrocarbon gases are burned in air and the flame temperature exceeds certain levels, it is known that nitrogen present in the air will combine with oxygen to form oxides of nitrogen such as nitrogen monoxide (NO) and nitrogen dioxide ($NO_2$). These oxides of nitrogen are usually formed simultaneously in the mixed combustion emission gases and are referred to collectively as $NO_x$, or "nitrogen oxides". Nitrogen oxides are air pollutants, and government regulations set strict limits on the maximum nitrogen oxide emissions from appliances. Consequently, considerable effort has been expended in the area of burner design with the goal of lowering $NO_x$ emissions.

Several approaches for lowering $NO_x$ emissions have been tried, but all to date have required expensive modifications to burner design. U.S. Pat. No. 4,904,179 to Drago and Ripka discloses a burner where a perforated metal screen is disposed in the flame to conduct heat from the flame in an attempt to lower $NO_x$ emissions. This approach disadvantageously requires the screen as a separate component of the burner assembly as well as some provision for mounting of the screen in an appropriate relationship to the rest of the burner assembly.

A gas burner using metal flame inserts in the form of slotted, inverted channel shaped members is disclosed in U.S. Pat. No. 4,616,994 to Tomlinson. The flame inserts of the Tomlinson disclosure are disposed on each side of the gas flames of the burner in contact with the inner cones of the burner flames. This burner design requires a separate assembly from the burner itself, the assembly then being mounted on the burner. The shape of these inserts is complicated and requires a number of manufacturing steps to fabricate.

A different system of flame inserts is disclosed in U.S. Pat. No. 4,652,236 to Viessmann. Flat vertical parallel fins are disposed between slot-shaped gas ports and extend perpendicularly above the gas burner. This arrangement places the fins in contact with the flames to draw heat from the flames. A chimney effect is also said to be produced with secondary air entering the flames and cooling the insert fins. The fins of this invention are disclosed as being separate pieces of material attached to a burner tube. The manufacture of this type of burner is complicated by the need to fabricate these fins separately and then attach them to the burner tube. This approach also reduces efficiency by removing energy intended for heating an external item.

U.S. Pat. No. 4,525,141 to DeWerth et al. describes flame inserts which are rod-shaped rather than flat. The rod-shaped flame inserts are arranged radially around a gas burner and spaced between the flames of the operating burner. Each flame is flanked by two inserts with the insert rods sized so as to have these rods in contact with the inner cones of the flames, which is said to lower the flame temperature by carrying heat away from the flame and radiating this heat. Although the burner allegedly reduces emissions of nitrogen oxides, the design disadvantageously requires more components for its manufacture than most conventional burners. The assembly of the additional components into the finished burner also requires a more complicated manufacturing process resulting in very high production costs.

U.S. Pat. No. 4,629,415 to DeWerth et al. discloses the use of rods formed into concentric rings supported around a circular gas burner. The rods are spaced from the burner ports and arranged vertically so that the gas flames project between the ring shaped rods. The ring-shaped rods of this burner design require additional component parts beyond the conventional burner housing: supports for the rods are needed to hold the rods in the proper position in relation to the burner ports so that the flames will properly contact the rods. These additional components and associated supporting structures increase the production costs associated with this burner.

Secondary air shields have also been used to control nitrogen oxide emissions from burners. Secondary air shields are believed to work by limiting the rate at which air needed for combustion diffuses into a flame. In conventional burners, primary air (air which is mixed with a fuel gas prior to combustion) is normally maintained below the stoichiometric amount required for complete combustion of the fuel gas to prevent detonation. Once ignited, the gas-primary air mixture burns in a flame, but additional air (secondary air) is required for complete burning of the fuel. Secondary air diffuses into a flame from the surrounding space to supply the balance of oxygen needed for complete stoichiometric combustion. By placing a barrier or shield in proximity to a flame, diffusion of secondary air into the flame is slowed. This is believed to affect the fuel gas burning rate in the flame in a manner which reduces emissions of nitrogen oxides.

A conventional use of secondary air shields can be seen in the burner disclosed in *Minimizing Emissions of Nitrogen Oxides from Domestic Water Heaters,* technical report ES66052D of the Southern California Gas Company, March, 1973, by W. S. Zawada. This report discloses the advantages of a gas burner provided with a solid annular air shield. disposed below the flames of a burner. The air shield is shown as an additional member affixed to the burner assembly, thereby adding to the complexity of the burner design and to its manufacturing cost. Further, the accompanying increase in size renders the burner impractical as a replacement in existing gas appliances.

Thus, known burners have not satisfied the long-felt need in the art for a burner which is inexpensive to produce and efficiently burns gaseous hydrocarbon fuel while producing lower nitrogen oxide emissions.

SUMMARY OF THE INVENTION

It is an object of the present invention to provide such a burner for use in water heaters and other appliances. It is a further object of the present invention to provide a gas burner which meets the following goals relative to a burner of conventional design:

1. Increased Recovery Efficiency
2. Reduced $NO_x$ and Carbon Monoxide Emissions
3. Quiet Operation
4. Multiple Fuel Utilization
5. Smooth Ignition and Extinction
6. Low Cost Other objects of the invention will become apparent from the description provided below.

The gas burner of the present invention comprises a coupled burner body and burner lid. A plurality of gas ports in a substantially circular and planar arrangement are interposed between the coupled body and lid and are directed radially from the body and lid. An air shield member is co-formed to and extends radially from the burner body or burner lid. Extending radially from the air shield member in substantial radial alignment with the gas ports is a plurality of flame partitions, the number of flame partitions being preferably equal to the number of gas ports. Each flame partition is an elongated member comprising two attached tabs which are substantially perpendicular to each other when the flame partition is observed in cross-section.

DETAILED DESCRIPTION OF THE INVENTION

Figure 1:
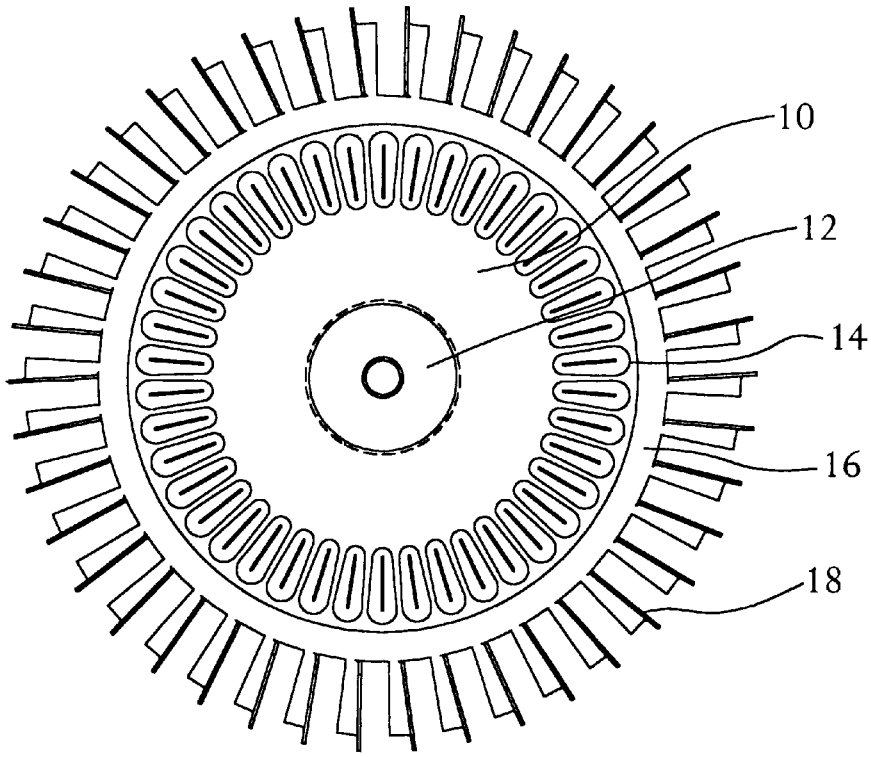
FIG. 1 is a top plan view of a body of a burner in accordance with the invention.

The burner of the present invention surprisingly overcomes the performance shortcomings of previous burner designs. It accomplishes this through an elegantly simple design, comprising only two low-cost stamped metal parts. More specifically, it was discovered by the inventors that the combined performance advantages of a flame insert and a secondary air shield are surprisingly realized from the easily-manufactured burner of the invention. The advantages of the invention are realized while also keeping the burner to a two piece design.

The invention exhibits several performance advantages when compared with a conventional gas burner for water heater use. A burner made according to the invention disclosed here satisfies the objects outlined above. When compared with a conventional burner of similar design and configuration, but the conventional burner having a burner body with a smooth lip in place of the flame partitions of the invention, a burner in accordance with the invention gave the following improvements in performance. Table I shows the results of a comparison trial of the conventional burner with the burner according to the invention. Recovery efficiency, excess air, and ignition time were all significantly improved with use of the burner of the invention. Emissions of carbon monoxide and nitrogen oxides were greatly reduced while carbon dioxide emission increased, showing improved overall combustion efficiency. The cost of manufacturing a burner in accordance with the invention was estimated to be approximately 66% lower than for a conventional burner. A burner according to the present invention is capable of operating with a variety of fuel gases at a wide range of line pressures, and can operate with methane as a fuel with a burner input range of from about 30,000 to about 80,000 Btu per hour. This corresponds to a port loading of about 1,550 Btu per port or 224,543 Btu per square inch.

TABLE 1

| Parameter | Performance of Conventional Burner | Performance of Burner of the Present Invention | Performance Improvement | Percentage Performance Improvement |
|---|---|---|---|---|
| Recovery Efficiency | 0.742 | 0.763 | increased | 2.8% |
| Carbon Monoxide | 106 ppm | 74 ppm | reduced | 30% |
| $NO_x$ | 88.9 ppm | 69.6 ppm | reduced | 22% |
| Carbon Dioxide | 9.20% | 9.95% | increased | 8% |
| Excess Air | 3.32% | 2.74% | reduced | 17% |
| Ignition Time | 1.4 sec | 0.5 sec | reduced | 64% |

The invention's design allows for the insertion of a burner in accordance with the invention through the access port of conventional water heaters, thus facilitating its installation as an environmentally-friendly replacement burner for existing water heaters. Burners according to other low-$NO_x$ designs require the disassembly of a conventional water heater for their installation therein, because the burners of these other designs cannot fit through the standard access port of a water heater.

The burner of the invention combines the performance advantages of a flame insert and a secondary air shield into a single structure co-formed either with the burner body or burner lid. The invention can be fabricated from sheet metal using conventional stamping techniques, and does not require the use of relatively expensive materials such as stainless steel or ceramics. The burner is formed from two generally circular pieces. A preferred embodiment of the invention is shown in the accompanying drawings which will now be discussed in detail. Those skilled in the art of burner design and construction will readily understand the method of manufacture of the novel burner disclosed herein, and its operation and advantages. In the included drawings, similar reference numbers are used to indicate corresponding elements in the different illustrated embodiments.

FIGS. 1 through 9 show a first embodiment of a burner according to the invention.

Referring to FIG. 1, an overhead view of a burner body 10 in accordance with the invention is shown. Starting from the center of FIG. 1, burner body 10 comprises a venturi 12, which possesses a plurality of primary air entrance points (not shown), 90 degrees to each other. Moving radially, burner body 10 also comprises bosses 14, each boss forming approximately one half of a gas port when the burner body is coupled coaxially with the burner lid to form a complete burner assembly. The preferred embodiment has 42 such bosses corresponding to 42 gas ports. Integral to burner body 10 is air shield member 16, which further toward the periphery is divided and formed into a skirt comprising a plurality of flame partitions 18 equal in number to the bosses and ports. Flame partitions 18 comprise a first tab and a second tab, said tabs at approximately right angles to each other (the tabs are clearly shown in FIG. 9). While the exact mechanism is not known, it is thought that these tabs function both as a flame insert and a secondary air shield to lower $NO_x$ and carbon monoxide emissions.

Figure 2:
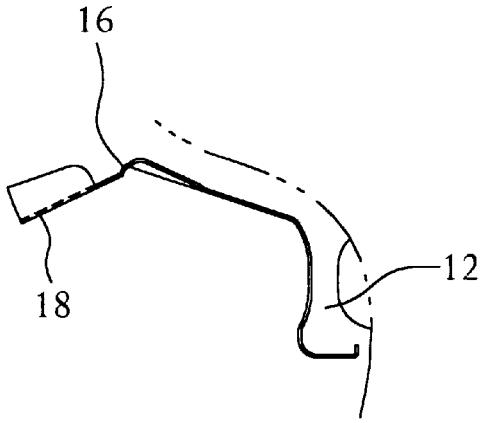
FIG. 2 is a side sectional view of a burner body, air shield member, and flame partition in accordance with the invention.

FIG. 2 is a transverse section of a burner body in accordance with the invention. The overall length of flame partition 18 measured radially from the air shield member 16 is preferably in the range of about 5/16 inch (7.9 mm) to about 1 inch ( 2.5 cm). The first tab can extend from about 1/32 inch (0.08 cm) to about 3/8 inch (9.5 mm) in a direction substantially perpendicular to the second tab, and the second tab can extend from about 3/16 inch (4.8 mm) to about 9/16 inch (14.3 mm) in a direction substantially perpendicular to the first tab, and the sum of the lengths of the first and second tabs in these directions preferably does not exceed 9/16 inch (14.3 mm). A flame partition 18 may be in any orientation about its longitudinal axis so long as the tabs remain substantially perpendicular to each other and at least one of the tabs extends in a direction that would intersect the plane of the gas ports.

Figure 3:
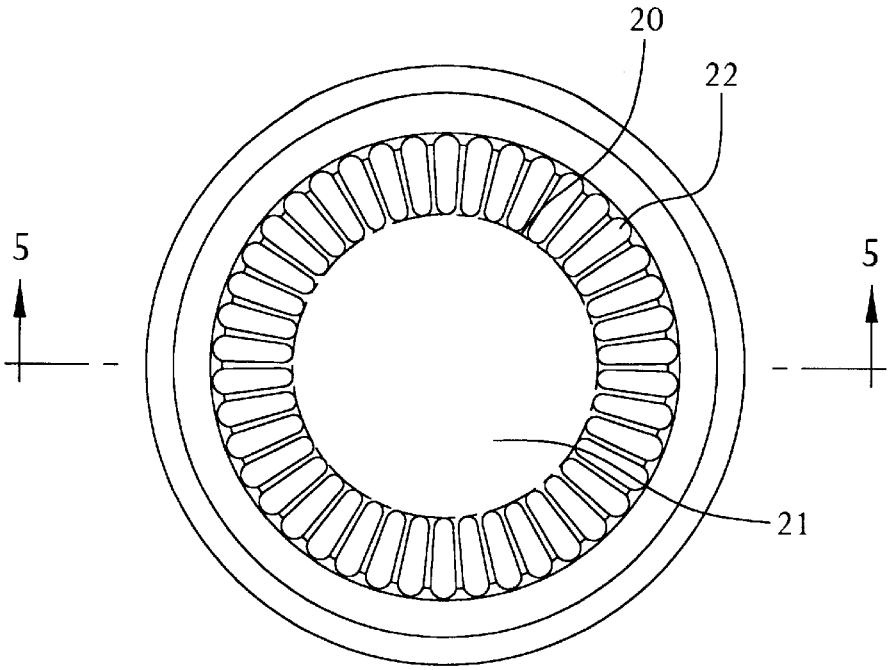
FIG. 3 is a bottom plan view of a burner lid in accordance with the invention.
Figure 4:
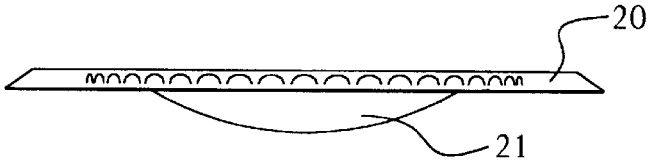
FIG. 4 is a side elevation view of the burner lid of FIG. 3.
Figure 5:
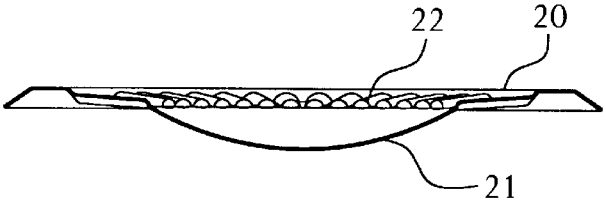
FIG. 5 is a transverse sectional view of the burner lid of FIG. 3.

The burner also comprises a burner lid, an example of which is shown for the first embodiment in FIG. 3 in bottom plan view. Burner lid 20 comprises a generally circular central portion 21 having a profile concave as seen from the top of the lid. The generally circular central portion 21 is from about 3.0 inches (7.6 cm) to about 3.5 inches (8.9 cm) in diameter. Burner lid 20 also comprises an array of bosses 22 formed on the burner lid, the bosses arranged radially around the generally circular central portion, each of the bosses constituting approximately one half of each gas port when the burner lid is coupled with the burner body described above. Coaxial coupling of a burner lid and a burner body into a complete burner assembly may be accomplished by a variety of methods known to those skilled in the art of metal fabrication, and is preferably achieved through spot welding. FIG. 4 shows the burner lid 20 of FIG. 3 in perspective, while FIG. 5 shows the burner lid 20 of FIG. 3 in transverse section.

Figure 6:
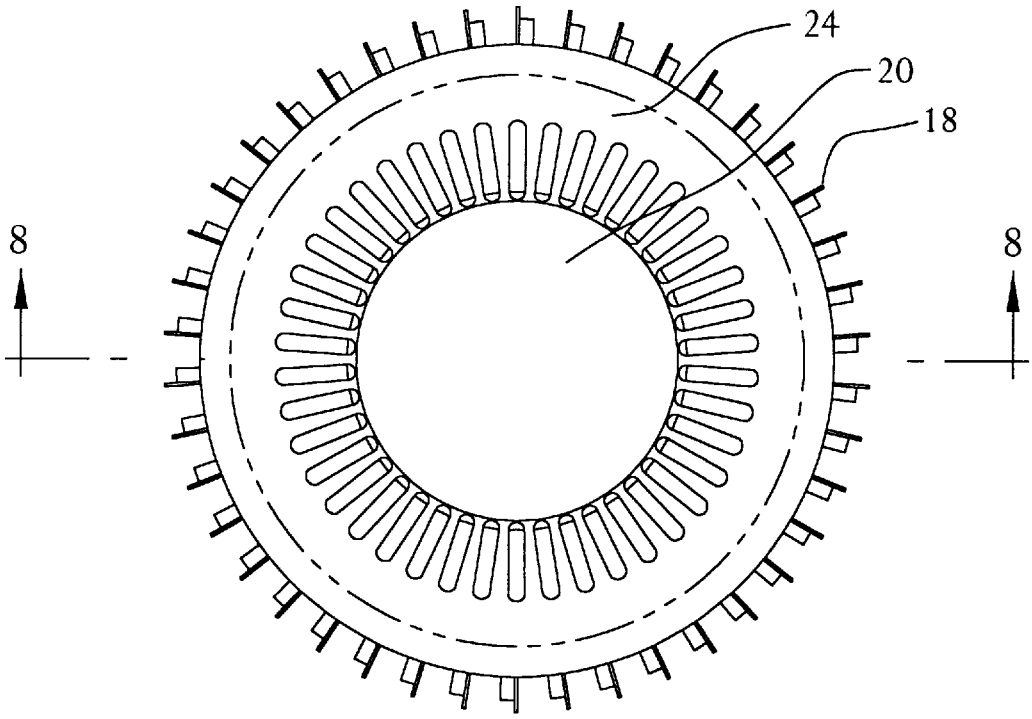
FIG. 6 is a top plan view of a burner in accordance with the invention.
Figure 7:
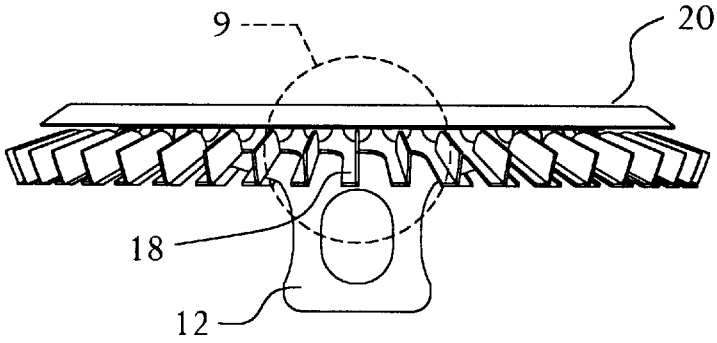
FIG. 7 is an side elevation view of the burner of FIG. 6.
Figure 8:
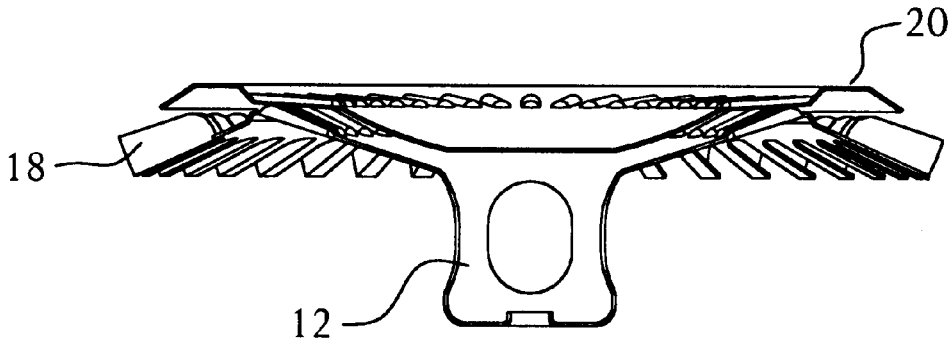
FIG. 8 is a transverse sectional view of a burner in accordance with the invention.

Referring to FIG. 6, a burner 24 in accordance with the invention may be seen in a top view with flame partitions 18 extending from below burner lid 20. FIG. 7 shows the burner of FIG. 6 in perspective, and shows a venturi 12. FIG. 8 shows a complete burner in accordance with the invention, in transverse section to more clearly illustrate the relationship of the elements of the invention to one another.

Figure 9:
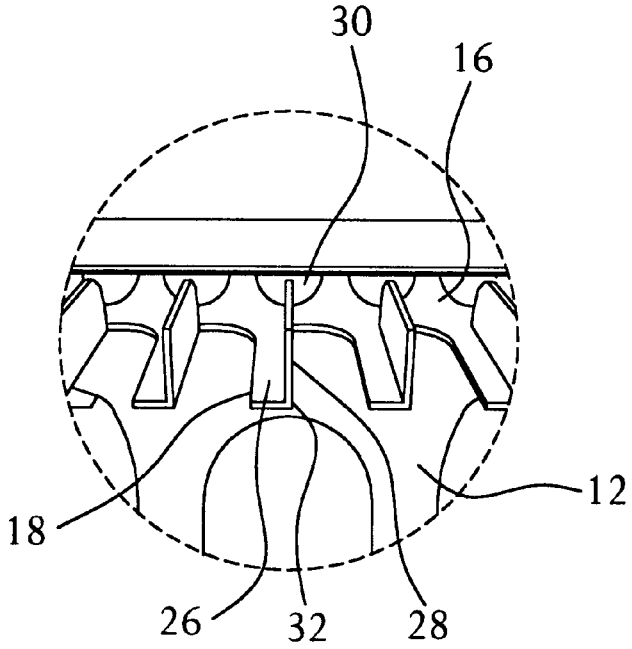
FIG. 9 is a detailed view of a portion of FIG. 7, showing details of a flame partition.

Referring now to FIG. 9, a detailed view of a portion of FIG. 7 is shown. In this figure the "L" shape of a flame partition 18 clearly depicted. First tab 26 of flame partition 18 is substantially perpendicular to second tab 28, said tabs being connected at fold 32. In this preferred embodiment, flame partition 18 extends radially at an angle of about 35 degrees to the planar arrangement of gas ports while remaining in substantial radial alignment with port 30. The angle between flame partitions 18 and the planar arrangement of gas ports preferably ranges from about 0 to 90 degrees, more preferably from about 20 to 50 degrees, and most preferably from about 35 degrees. Second tab 28 is positioned to contact and divide the flame that would emanate from the port 30. First tab 26 is positioned below the flame. In a preferred embodiment as shown, the first tab is extended and disposed below a flame proceeding from gas port 30, where it may shield the flame from diffusion from below of secondary air. The second tab is disposed in the flame, where it may function as a flame insert, elongating and removing heat from the flame.

Figure 10:
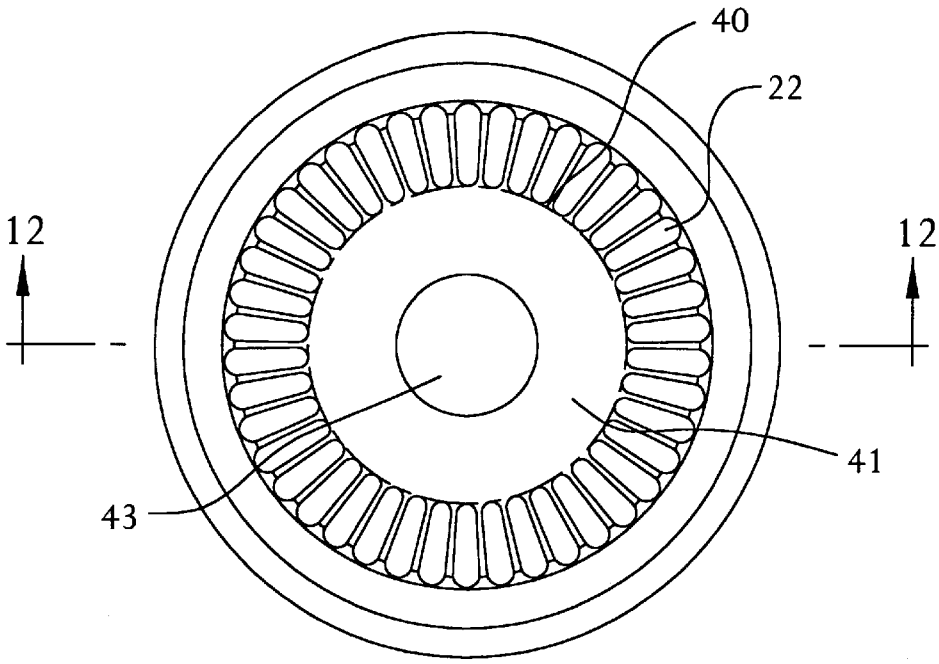
FIG. 10 is a bottom plan view of a burner lid of a second embodiment in accordance with the invention.

A second, alternative embodiment of a burner in accordance with the invention is shown in FIGS. 10 through 14. Referring to FIG. 10, an alternative form of a burner lid 40 comprises an array of bosses 22. The burner lid 40 also comprises a generally circular central portion 41 having a truncated concave shape as viewed from the top of the lid. The generally circular central portion 41 is from about 3.0 inches (7.6 cm) to about 3.5 inches (8.9 cm) in diameter. The generally circular central portion 41 is capped by a generally circular planar portion 43 forming the truncation, and the generally circular planar portion having a diameter of from about ¼ inch (0.6 mm) to about 2 inches (5.1 cm), and preferably having a diameter of about 1½ inches (3.8 cm).

Figure 11:
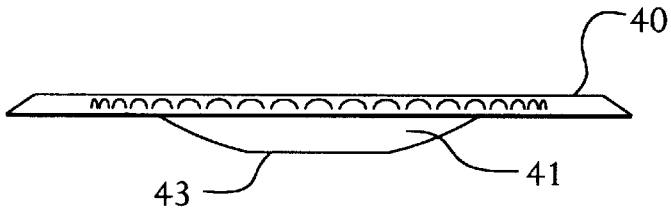
FIG. 11 is a side elevation view of the burner lid of FIG. 10.
Figure 12:
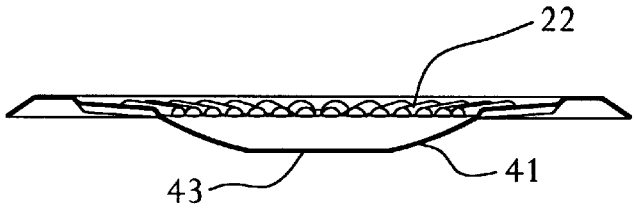
FIG. 12 is a transverse sectional view of the burner lid of FIG. 10.

FIG. 11 shows a side elevation of the alternative burner lid of FIG. 10. This latter figure clearly shows the truncated dome shaped generally circular central portion 41, and the circular planar portion 43. FIG. 12 shows a transverse section of the alternative burner lid of FIG. 10.

Figure 13:
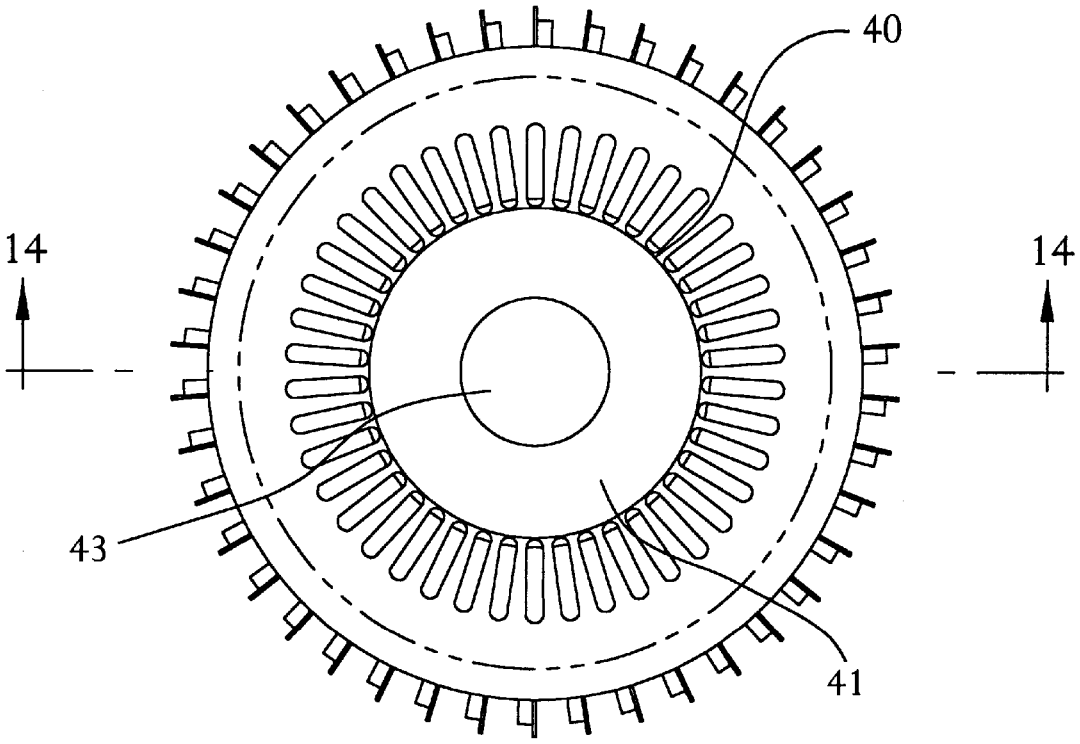
FIG. 13 is a top plan view of a burner of the second embodiment in accordance with the invention.

FIG. 13 shows a top plan view of a complete mated burner according to the invention, where the alternative burner lid 40 is used with the burner body of FIG. 1. Coaxial coupling of the burner lid with the burner body may be accomplished by a method such as spot welding, as described above for the first embodiment.

Figure 14:
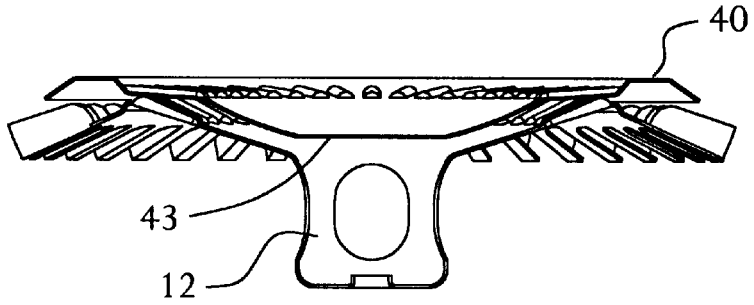
FIG. 14 is a transverse sectional view of the burner of FIG. 13.

In FIG. 14 is shown the transverse section of the second alternative embodiment of a burner in accordance with the invention, showing the relationship of the circular planar portion 43 of the burner lid to the venturi 12.

It has also been discovered that improvements in burner performance can be achieved by use of the flame partitions of the invention, even when the number of flame partitions is fewer than the number of gas ports in a burner. Although it is preferred to have these two numbers equal, a burner's operation can still benefit from providing the inventive flame partitions disposed around the burner.

Figure 15:
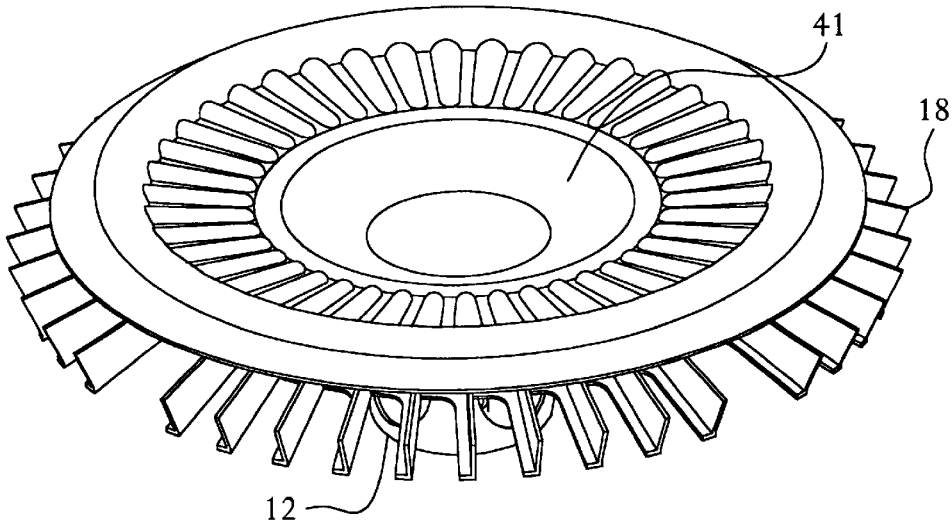
FIG. 15 is a perspective view of a third embodiment in accordance with the invention.

FIG. 15 illustrates a third embodiment of a burner in accordance with the invention. In this embodiment the burner is ringed around its periphery with flame partitions 18 in similar construction and arrangement to the embodiments disclosed above except for a sector 48, that is devoid of a flame partition. As shown in the figure, the sector 48 may be repeated at four spaced apart locations around the burner embodiment. A burner according to the teachings of the present invention may have such a sector that is devoid of a single flame partition, or may have a plurality of sectors devoid of a single flame partition. If a plurality of such sectors is present, it is preferred that the sectors be equally spaced apart from one another. For example, if four such sectors are present in a burner according to the invention, it is preferred that the four sectors be disposed at twelve, three, six and nine o'clock positions about the burner.

Figure 16:
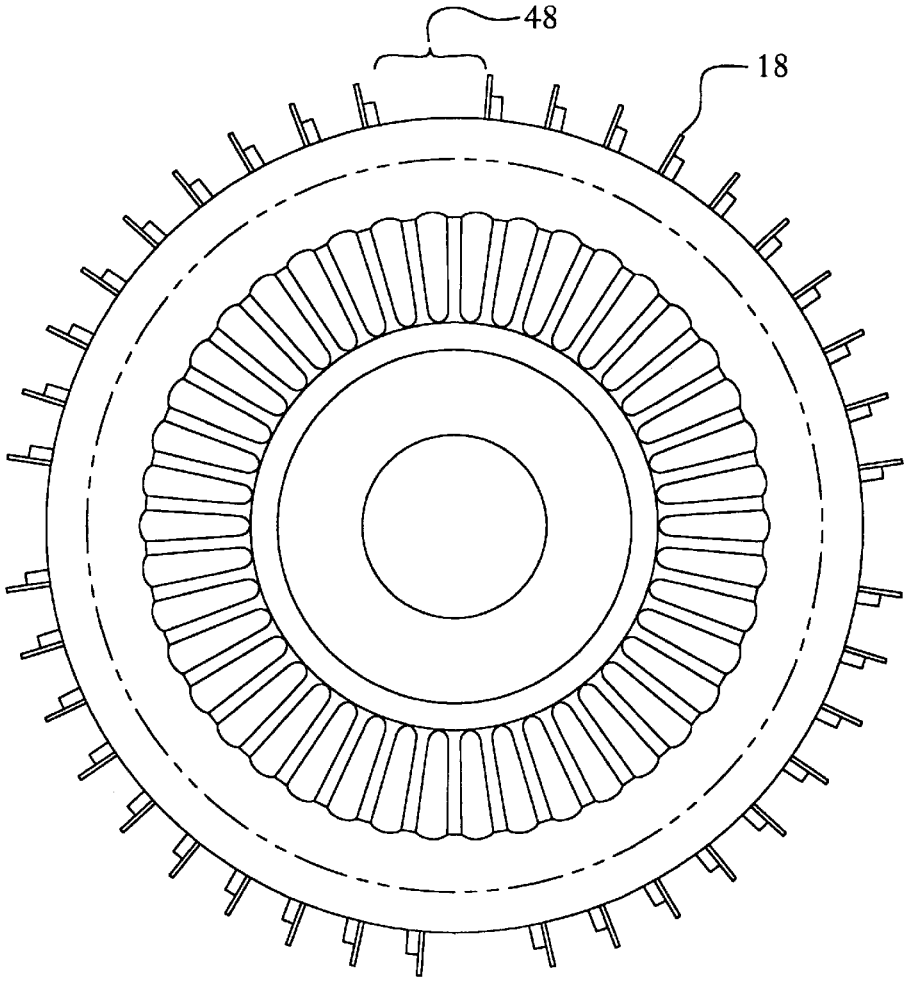
FIG. 16 is a top plan view of the embodiment of FIG. 15.

FIG. 16 illustrates a top plan view of a complete mated burner of the third embodiment according to the invention, where the embodiment lacks a flame partition, providing a sector 48 that is repeated at three other spaced apart locations around the burner of this embodiment.

Figure 17:
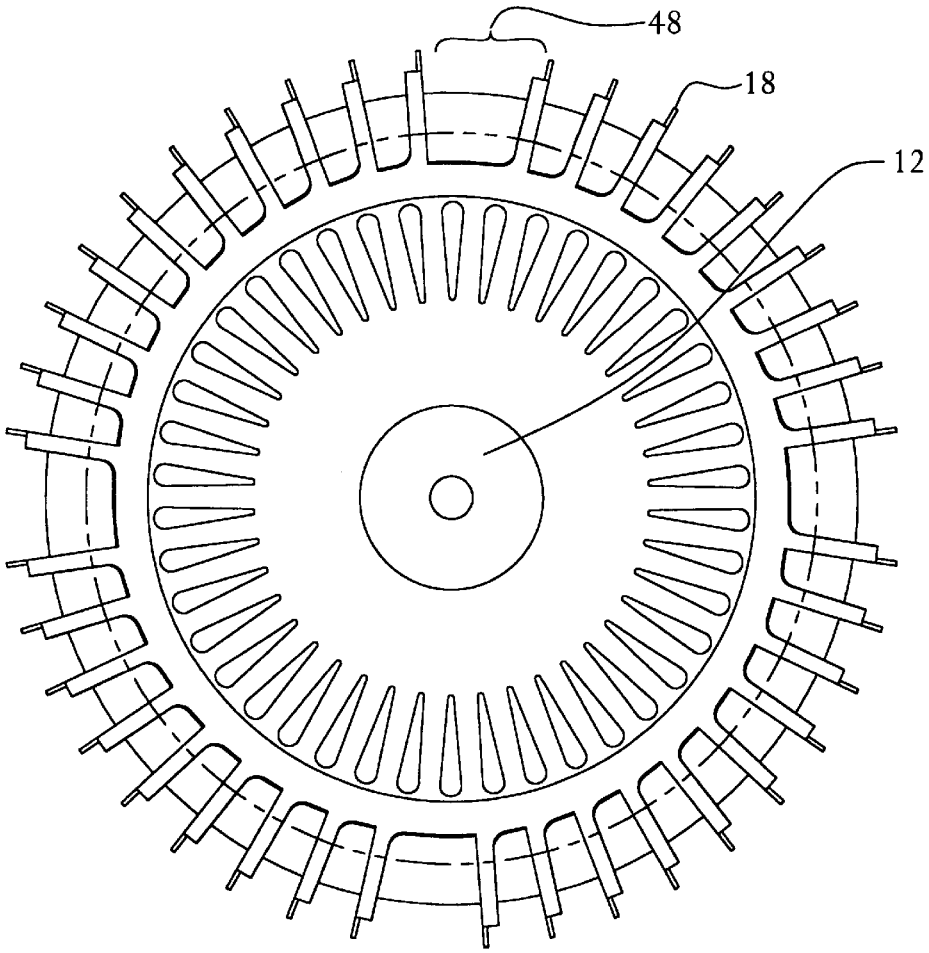
FIG. 17 is a bottom plan view of the embodiment of FIG. 15.

FIG. 17 illustrates a bottom plan view of the third embodiment according to the invention. Clearly visible is the sector 48 without flame partitions, with the sector at the twelve o'clock position being repeated at the three, six and nine o'clock positions.

Figure 18:
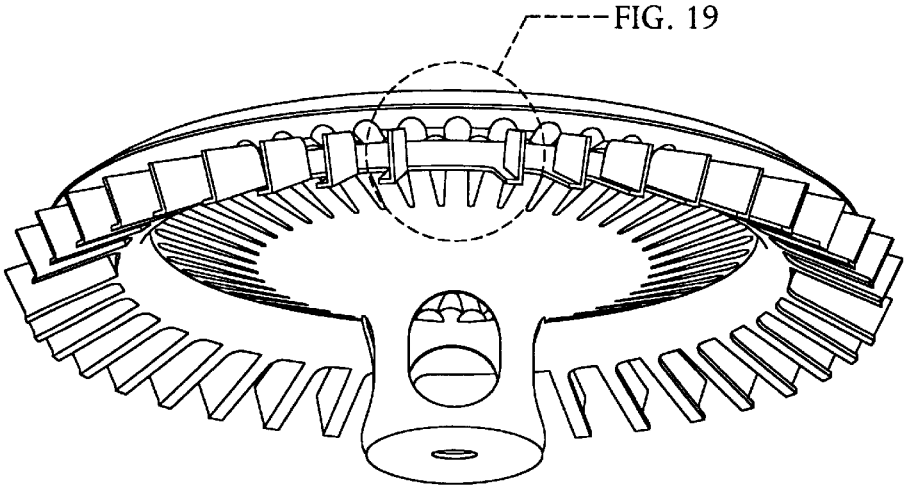
FIG. 18 is a side elevation view of the embodiment of FIG. 15, showing a gas port.
Figure 19:
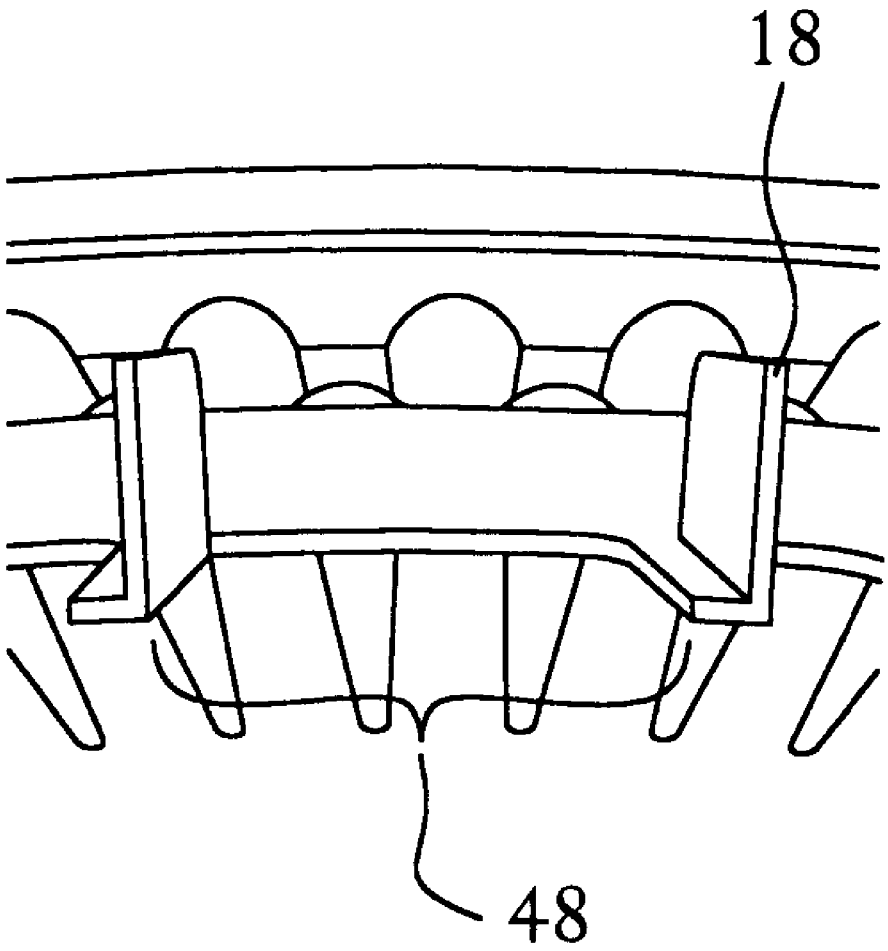
FIG. 19 is a detailed view of a portion of FIG. 18, showing a detail of the air shield member.

Turning to FIG. 18, an elevation view of the third embodiment may be seen that shows a gas port visible within the sector without flame partitions. FIG. 19 provides a detailed view of this gas port, the gas port having no flame partition 18 disposed before it.

Figure 20:
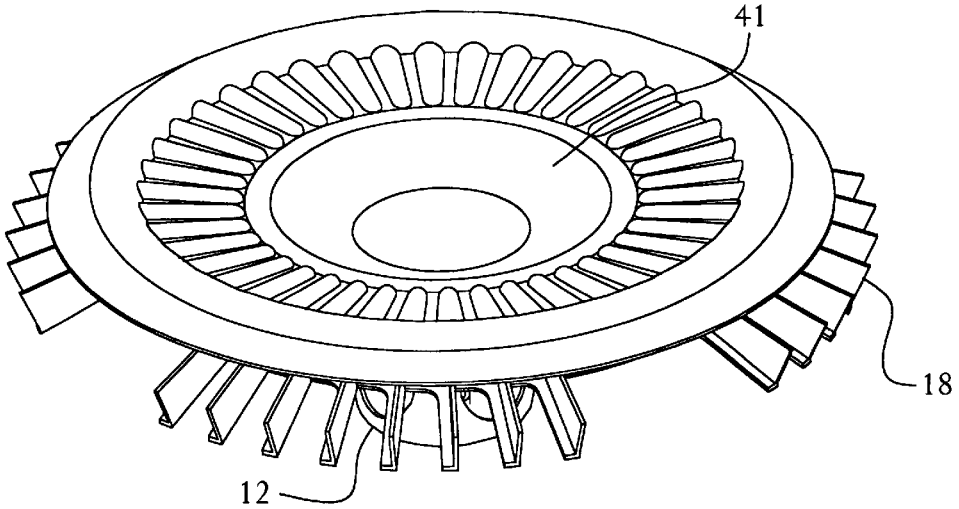
FIG. 20 is a perspective view of a fourth embodiment of a burner in accordance with the invention.
Figure 21:
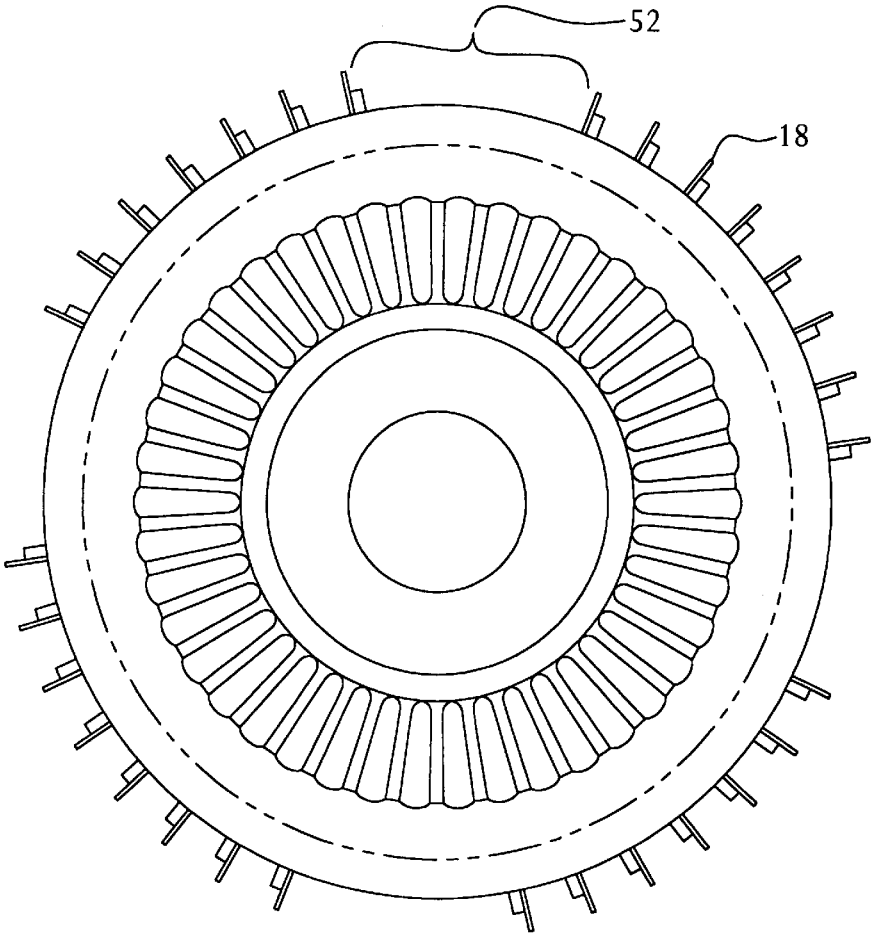
FIG. 21 is a top plan view of the embodiment of FIG. 20.

FIG. 20 illustrates a fourth embodiment of a burner in accordance with the invention. In this embodiment the burner is ringed around its periphery with flame partitions 18 except for a sector 52, that is devoid of three flame partitions. As shown in the figure, the sector 52 is present at four spaced apart locations around the burner embodiment. The construction and arrangement of the fourth embodiment is similar to the third embodiment disclosed above except for the size of the sector 52. A burner according to the teachings of the present invention may have such a sector that is devoid of a plurality of flame partitions, or may have a plurality of sectors devoid of a plurality of flame partition. If a plurality of such sectors are present, it is preferred that the sectors be spaced apart from one another. For example, if four such sectors are present in a burner according to the invention, it is preferred that the four sectors be disposed at twelve, three, six and nine o'clock positions about the burner. FIG. 21 shows a top plan view of the fourth embodiment.

TABLE 2

| Flame Partitions: | 42 | 38 | 34 | 30 | 26 | 22 |
|---|---|---|---|---|---|---|
| Combustion Efficiency (%) | 81.85 | 80.77 | 80.4 | 79.99 | 79.49 | 79.17 |
| Carbon Dioxide (%) | 9.40 | 9.40 | 9.40 | 9.40 | 9.45 | 9.40 |
| Carbon Monoxide (ppm) | 15 | 15 | 15 | 15 | 15 | 15 |
| $NO_x$ (ppm) | 58 | 56.8 | 58.7 | 59.8 | 60.4 | 61.7 |

In Table 2 are seen data from a comparison of the performance of a burner according to the invention having 42 of the inventive flame partitions, compared with burners having fewer than 42 flame partitions. The data of Table 2 were obtained from tests with burners installed in a water heater, with a different water heater being used than that used for the tests of Table 1. The Table 2 data show that as fewer flame partitions are used with a burner of the inventive construction, there is a trend for the $NO_x$ being produced by the burner to increase. As may be seen in Table 2, the $NO_x$ output of a burner increased from 58 ppm to 61.7 ppm as the number of flame partitions was reduced from 42 to 22. With 22 flame partitions on the test burner used, four sectors, each devoid of five flame partitions were spaced about the burner.

The novel design of the invention permits inexpensive manufacture with a minimum of parts. Further, the elongated elements of the invention surprisingly provide the performance advantages of both a flame insert and a secondary air shield. As a result, the invention provides an efficient, low $NO_x$ and low carbon monoxide burner at low cost. The invention is particularly suited for use in appliances such as water heaters, and burners of the invention can be readily installed as a replacement for less efficient, higher $NO_x$ burners in older water heaters and appliances.

Although four embodiments of a burner according to this invention have been shown and described in detail above, those skilled in the art will readily appreciate that many modifications may be made to these embodiments without departing from the spirit and scope of the invention defined in the appended claims.

All patents, patent applications, and publications mentioned herein are hereby incorporated by reference.

We claim:

1. A burner, comprising:

a) a burner body;

b) a burner lid coupled to said burner body so as to form a plurality of gas ports in a substantially circular and substantially planar arrangement, said gas ports being interposed between said burner body and said burner lid and adapted to have a corresponding array of flames extending therefrom during combustion of a fuel gas;

c) an air shield member co-formed to and extending radially from said burner body; and d) a plurality of flame partitions, each flame partition being co-formed to said air shield member and extending radially from said air shield member along an axis, said flame partitions being spaced around said air shield member so that each flame partition is in substantial radial alignment with one of said plurality of gas ports, each of said flame partitions comprising a first tab and a second tab, said first tab and said second tab being connected along said axis and extending radially from said axis such that said first and second tabs are substantially perpendicular, wherein at least one of said tabs extends in a direction that would intersect a plane formed by said substantially planar arrangement of gas ports, and wherein the number of flame partitions is less than the number of gas ports.

2. The burner of claim 1, wherein each of said flame partitions has a length along said axis from about 5/16 inch to about 1 inch, said first tab extends radially from said axis for about 1/32 inches to about 3/8 inch, said second tab extends radially from said axis for a length of about 3/16 inch to about 9/16 inch, and wherein the sum of said length of said first tab and said length of said second tab does not exceed about 9/16 inch.

3. The burner of claim 2, wherein said axis of said each flame partition and said plane formed by said substantially planar arrangement of gas ports form an angle of from about 0 degrees to about 90 degrees.

4. The burner of claim 3, wherein said angle is from about 20 degrees to about 50 degrees.

5. The burner of claim 3, wherein said angle is about 35 degrees from the horizontal.

6. The burner of claim 1, wherein one of said first tab and said second tab is substantially perpendicular to said substantially planar arrangement of gas ports.

7. A gas fired appliance comprising the burner of claim 1.

8. A water heater comprising the burner of claim 1.

9. A gas fired appliance comprising the burner of claim 6.

10. A water heater comprising the burner of claim 6.

11. The burner of claim 1, wherein said burner lid comprises a central concave portion.

12. The burner of claim 11, wherein each of said flame partitions has a length along said axis from about 5/16 inch to about 1 inch, said first tab extends radially from said axis for about 1/32 inch to about 3.8 inch, said second tab extends radially from said axis for a length of about 3/16 inch to about 9/16 inch, and wherein the sum of said length of said first tab and said length of said second tab does not exceed about 9/16 inch.

13. The burner of claim 12, wherein said axis of said each flame partition and said plane formed by said substantially planar arrangement of gas ports form an angle of from about 0 degrees to about 90 degrees.

14. The burner of claim 13, wherein said angle is from about 20 degrees to about 50 degrees.

15. The burner of claim 14, wherein said angle is about 35 degrees.

16. The burner of claim 11, wherein one of said first tab and said second tab is substantially perpendicular to said substantially planar arrangement of gas ports.

17. A gas fired appliance comprising the burner of claim 11.

18. A water heater comprising the burner of claim 11.

19. The burner of claim 1, wherein said burner lid comprises a central truncated concave portion.

20. The burner of claim 19, wherein each of said flame partitions has a length along said axis from about 5/16 inch to about 1 inch, said first tab extends radially from said axis for about 1/32 inch to about 3.8 inch, said second tab extends radially from said axis for a length of about 3/16 inch to about 9/16 inch, and wherein the sum of said length of said first tab and said length of said second tab does not exceed about 9/16 inch.

21. The burner of claim 20, wherein said axis of said flame partition and said plane formed by said substantially planar arrangement of gas ports form an angle of from about 0 degrees to about 90 degrees.

22. The burner of claim 21, wherein said angle is from about 20 degrees to about 50 degrees.

23. The burner of claim 22, wherein said angle is about 35 degrees.

24. The burner of claim 19, wherein one of said first tab and said second tab is substantially perpendicular to said substantially planar arrangement of gas ports.

25. A gas fired appliance comprising the burner of claim 19.

26. A water heater comprising the burner of claim 19.

27. A burner, comprising:

a) a burner body;

b) a burner lid coupled to said burner body so as to form a plurality of gas ports in a substantially circular and substantially planar arrangement, said gas ports being interposed between said burner body and said burner lid and adapted to have a corresponding array of flames extending therefrom during combustion of a fuel gas;

c) an air shield member co-formed to and extending radially from said burner lid; and d) a plurality of flame partitions, each flame partition being co-formed to said air shield member and extending radially from said air shield member along an axis, said flame partitions being spaced around said air shield member so that each flame partition is in substantial radial alignment with one of said plurality of gas ports, each flame partition comprising a first tab and a second tab, said first tab and said second tab being connected along said axis and extending radially from said axis such that said first and second tabs are substantially perpendicular, wherein at least one of said tabs extends in a direction that would intersect a plane formed by said substantially planar arrangement of gas ports.

28. The burner of claim 27, wherein each of said flame partitions has a length along said axis from about 5/16 inch to about 1 inch, said first tab extends radially from said axis for about 1/32 inch to about 3/8 inch, said second tab extends radially from said axis for a length of about 3/16 inch to about 9/16 inch, and wherein the sum of said length of said first tab and said length of said second tab does not exceed about 9/16 inch.

29. The burner of claim 28, wherein said axis of said each flame partition and said plane formed by said substantially planar arrangement of gas ports form an angle of from about 0 degrees to about 90 degrees.

30. The burner of claim 29, wherein said angle is from about 20 degrees to about 50 degrees.

31. The burner of claim 30, wherein said angle is about 35 degrees.

32. The burner of claim 27, wherein one of said first tab and said second tab is substantially perpendicular to said substantially planar arrangement of gas ports.

33. A gas fired appliance comprising the burner of claim 27.

34. A water heater comprising the burner of claim 27.

* * * * *